US009409738B2

(12) United States Patent
Hasegawa

(10) Patent No.: US 9,409,738 B2
(45) Date of Patent: Aug. 9, 2016

(54) PRINTING APPARATUS AND CONTROL METHOD

(71) Applicant: CANON KABUSHIKI KAISHA, Tokyo (JP)

(72) Inventor: Kazuhide Hasegawa, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/821,869

(22) Filed: Aug. 10, 2015

(65) Prior Publication Data

US 2016/0052743 A1 Feb. 25, 2016

(30) Foreign Application Priority Data

Aug. 20, 2014 (JP) ..... 2014-167956

(51) Int. Cl.

| | |
|---|---|
| ***B65H 31/24*** | (2006.01) |
| ***B65H 43/00*** | (2006.01) |
| ***B65H 29/60*** | (2006.01) |
| ***B65H 31/32*** | (2006.01) |
| *G03G 15/00* | (2006.01) |

(52) U.S. Cl.

CPC ..... *B65H 31/24* (2013.01); *B65H 29/60* (2013.01); *B65H 31/32* (2013.01); *B65H 43/00* (2013.01); *G03G 15/6538* (2013.01); *B65H 2405/15* (2013.01); *B65H 2801/06* (2013.01); *B65H 2801/27* (2013.01); *G03G 15/5012* (2013.01); *G03G 15/6547* (2013.01)

(58) Field of Classification Search

CPC ..... B65H 31/24; B65H 31/30; B65H 37/04; B65H 43/00; B65H 43/06; B65H 2301/16; B65H 2301/165

USPC ..... 271/298

See application file for complete search history.

(56) References Cited

U.S. PATENT DOCUMENTS

2005/0017426 A1* 1/2005 Hirata ..... B65H 37/00 270/58.08

2014/0159306 A1* 6/2014 Nonaka ..... B65H 29/60 271/288

FOREIGN PATENT DOCUMENTS

JP 2009-160849 A 7/2009

* cited by examiner

*Primary Examiner* — David H Bollinger

(74) *Attorney, Agent, or Firm* — Carter, DeLuca, Farrell & Schmidt LLP

(57) ABSTRACT

Sheet discharge preparation is performed in a finisher that is different to the stacking apparatus, before the discharge of sheets to the stacking apparatus is interrupted by the operation of the stacking apparatus for sliding stacked sheets to a position for user retrieval. When sheet discharge preparation is performed in the finisher, a second job in which sheets are discharged to the finisher is executed.

10 Claims, 17 Drawing Sheets

FIG. 8

800

| # (801) | STATUS (802) | INPUT INFORMATION (803) | | | OUTPUT INFORMATION (804) | | | | No. OF SHEETS FOR INTERRUPTION ANNOUNCEMENT (813) | No. OF SHEETS PROCESSED DURING INTERRUPTION (814) | DATA STORAGE DESTINATION (805) |
|---|---|---|---|---|---|---|---|---|---|---|---|
| | | OUTPUT DESTINATION (806) | No. OF PAGES (807) | No. OF SETS (808) | OUTPUT DESTINATION (809) | No. OF PAGES (810) | No. OF SETS (811) | No. OF OUTPUT SHEETS (812) | | | |
| 1 | INTERRUPTED | STACKER | 20 | 500 | STACKER | 20 | 150 | 3000 | 2800 | 0 | /AAA/0001 |
| 2 | PRINTING | AUTOMATIC | 20 | 200 | TRAY 1 | 10 | 4 | 90 | 0 | 100 | /AAA/0002 |
| 3 | PRINT STANDBY | STACKER | 30 | 500 | STACKER | 0 | 0 | 0 | 0 | 0 | /AAA/0003 |
| 4 | PRINT STANDBY | AUTOMATIC | 10 | 2 | UNDETERMINED | 0 | 0 | 0 | 0 | 0 | /AAA/0004 |
| 5 | RENDERING | AUTOMATIC | 20 | 200 | UNDETERMINED | 0 | 0 | 0 | 0 | 0 | /AAA/0005 |

FIG. 11

801 802 803 804 No. OF SHEETS FOR INTERRUPTION ANNOUNCEMENT No. OF SHEETS TO BE PROCESSED DURING INTERRUPTION OUTPUT PRIORITY RANKING 805 800

| # | STATUS | INPUT INFORMATION | | | OUTPUT INFORMATION | | | | 813 | 814 | 1101 | DATA STORAGE DESTINATION |
|---|---|---|---|---|---|---|---|---|---|---|---|---|
| | | OUTPUT DESTINATION | No. OF PAGES | No. OF SETS | OUTPUT DESTINATION | No. OF PAGES | No. OF SETS | No. OF OUTPUT SHEETS | | | | |
| 1 | INTERRUPTED | STACKER | 20 | 500 | STACKER | 20 | 150 | 3000 | 2800 | – | 0 | /AAA/0001 |
| 2 | PRINTING | AUTOMATIC | 20 | 200 | TRAY 1 | 10 | 4 | 90 | – | 100 | 2 | /AAA/0002 |
| 3 | PRINT STANDBY | STACKER | 30 | 500 | STACKER | 0 | 0 | 0 | – | – | 0 | /AAA/0003 |
| 4 | PRINT STANDBY | AUTOMATIC | 10 | 2 | UN-DETERMINED | 0 | 0 | 0 | – | – | 1 | /AAA/0004 |
| 5 | RENDERING | AUTOMATIC | 20 | 200 | UN-DETERMINED | 0 | 0 | 0 | – | – | 3 | /AAA/0005 |

806 807 808 809 810 811 812

PRINTING APPARATUS AND CONTROL METHOD

BACKGROUND OF THE INVENTION

1. Field of the Invention

The present invention relates to a printing apparatus that can discharge sheets to a stacking apparatus and a control method.

2. Description of the Related Art

A configuration is known in which while a preceding job is performing post-processing such as book binding, sheets of a succeeding job are discharged to a sheet discharging apparatus different from the sheet discharging apparatus that performs post-processing such as book binding (Japanese Patent Laid-Open No. 2009-160849). Also, there is a high-capacity stacking apparatus such as a stacker that includes a stacking tray for stacking sheets in the stacker, and a discharge tray that discharges bundles of sheets to the outside of the device. This stacking apparatus configuration is known to perform continuous stacking of sheets to the stacking tray by automatically discharging the discharge tray to the outside of the apparatus when fully stacked with sheets.

In Japanese Patent Laid-Open No. 2009-160849, when print processing for one set in the preceding job is complete, processing of the preceding job is interrupted, and processing of the succeeding job is started. Also, when a notification of book binding processing completion for one set in the preceding job is received, processing of the succeeding job is interrupted, and remaining processing of the preceding job is resumed.

Normally, the sheet discharging apparatus needs to prepare for sheet discharge processing in order for the sheet discharging apparatus to begin sheet discharge processing. For this reason, sheet discharge processing cannot be immediately started when the sheet discharging apparatus is switched from the preceding job to the succeeding job, or from the succeeding job to the preceding job. On the other hand, in a high-capacity stacking apparatus such as a stacker, there is a need to interrupt the discharge of sheets to the stacker during a switch from the stacking tray to the discharge tray and the period it takes for the stacking of sheets to the stacking tray to resume.

SUMMARY OF THE INVENTION

An aspect of the present invention is to eliminate the above-mentioned problems with the conventional technology. The present invention provides a printing apparatus and a control method that improves processing efficiency in the case in which multiple jobs are processed in a printing apparatus that can discharge sheets to a stacking apparatus.

The present invention in one aspect provides a printing apparatus that can discharge sheets to a stacking apparatus that includes a first stacking unit onto which discharged sheets are stacked, and a second stacking unit onto which the sheets stacked onto the first stacking unit can be caused to slide from the first stacking unit to a position for user retrieval, the printing apparatus comprising: a first control unit configured to control execution of a first job of discharging sheets to the stacking apparatus, and a second job of discharging sheets to a finisher that is different from the stacking apparatus; and a second control unit configured to perform sheet discharge preparation in the finisher before the discharge of sheets to the stacking apparatus is interrupted by an operation for sliding the stacked sheets to the position for the user retrieval, wherein the first control unit executes the second job when sheet discharge preparation is performed in the finisher by the second control unit.

According to the present invention, processing efficiency can be improved in the case of processing multiple jobs in a printing apparatus that can discharge sheets to a stacker.

Further features of the present invention will become apparent from the following description of exemplary embodiments with reference to the attached drawings.

BRIEF DESCRIPTION OF THE DRAWINGS

FIG. 8 is a diagram showing a job management table.

FIG. 11 is a diagram showing a job management table that manages job priority rankings.

DESCRIPTION OF THE EMBODIMENTS

Preferred embodiments of the present invention will now be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention. Note that the same configuration elements have the same reference numbers, and redundant descriptions have been omitted.

First Embodiment

Figure 1:
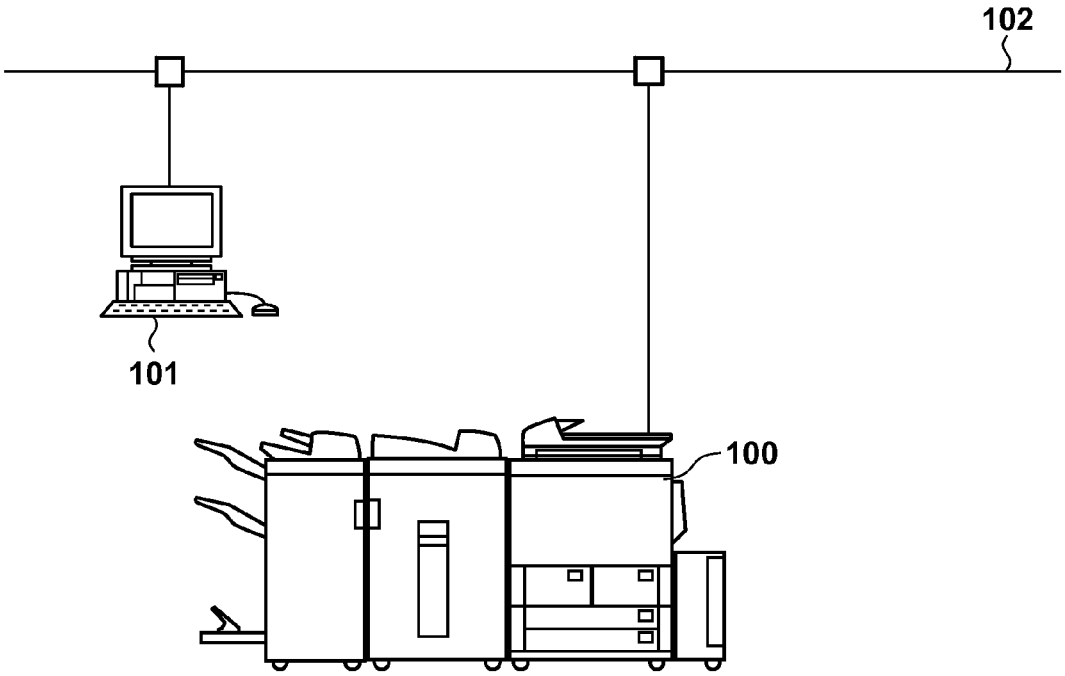
FIG. 1 is a diagram showing an overall configuration of a printing system.

FIG. 1 is a diagram showing the overall configuration of a printing system. As shown in FIG. 1, a printing apparatus 100 is connected to an information processing apparatus 101 via a network 102 such as a LAN so that mutual communication is possible. The network 102 may be a wired network, or it may be a wireless network. The printing apparatus 100 performs printing on printing mediums such as printing sheets by an ink jet printing method, electrophotographic printing method, or the like. The printing apparatus 100 may be a multi-functional printer (MFP) in which a function that optically reads an original, a copy function, a FAX function and the like are integrated. The printing apparatus 100 is described below as an MFP. The information processing apparatus 101 is, for example, a generic PC that has a CPU, a display, a keyboard, a pointing device, a hard disk drive (HDD), a memory, a network communication interface, and the like. The information processing apparatus 101 transmits job data to the printing apparatus 100 in a data format that the printing apparatus 100 can print, such as job data that has been converted into PDL data. The printing apparatus 100 performs printing based on job data transmitted from the information processing apparatus 101.

Figure 2:
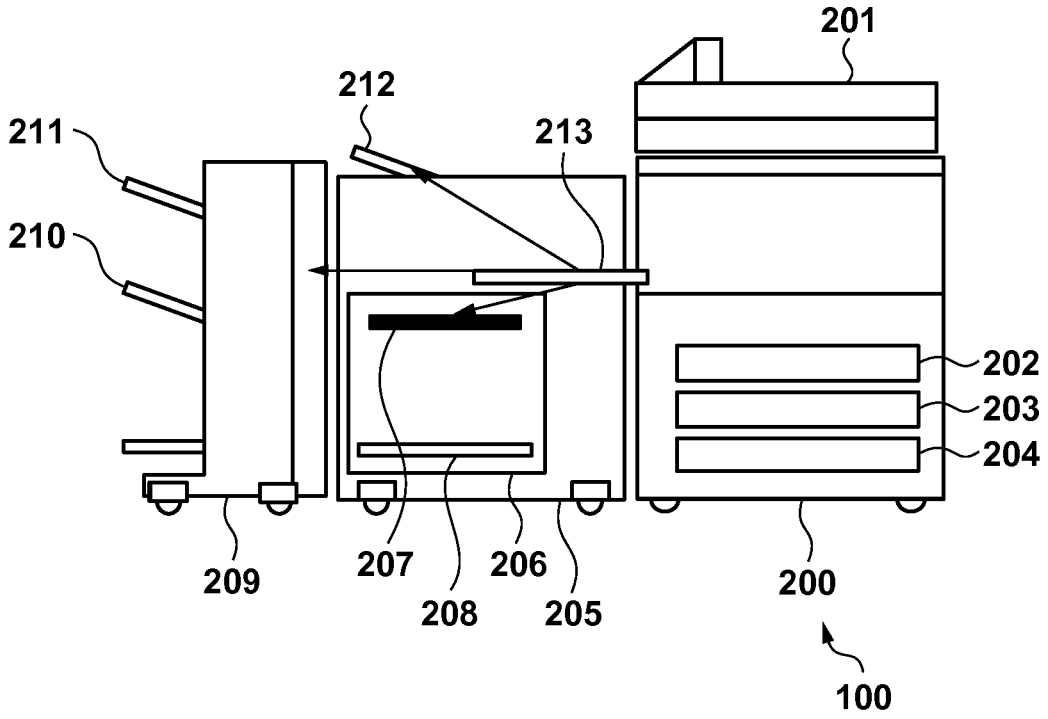
FIG. 2 is a diagram showing a configuration of a printing apparatus.

FIG. 2 is a diagram showing the configuration of the printing apparatus 100. The printing apparatus 100 includes an MFP body 200, a stacker (a stacking apparatus) 205, and a finisher 209. As shown in FIG. 2, the stacker 205 is connected to the downstream side of the MFP body 200, the finisher 209 is connected further downstream, and the MFP body 200 can discharge sheets to the stacker 205 and the finisher 209.

An automatic document feeder (ADF) provided in the upper portion of the MFP body 200 provides originals one sheet at a time to a reading unit. Sheet feeding cassettes 202, 203 and 204 provided in the MFP body 200 store sheets for printing by a printing unit (a printer engine) of the MFP body 200. The stored sheets are conveyed to the printing unit of the MFP body 200 by sheet feeding conveyer rollers, or the like.

The stacker 205 discharges sheets printed by the MFP body 200 to a stacker unit 206. The stacker unit 206 is generally used when discharging a large amount of sheets in one go. The stacker unit 206 has a lift tray 207 and a discharge tray 208. The lift tray 207 stacks sheets that have been discharged to the stacker unit 206. The discharge tray 208 discharges a sheet bundle having a predetermined amount of stacked sheets on the lift tray 207 to the outside of the stacker 205. The configuration of the lift tray 207 and the discharge tray 208 will be described later. A sample tray 212 discharges sheets printed by the MFP 200. The sample tray 212 is used in the case in which the user wants to confirm an image on a sheet that is being discharged in a large volume to the stacker unit 206 by checking a sample print, for example.

The finisher 209 executes various types of finishing processes such as saddle stitch book binding and staple processing on sheets printed by the MFP body 200, and discharges the sheets to sheet discharge trays 210 or 211. The finisher 209 is also called a sheet processing apparatus or a saddle stitch book binding apparatus.

As described above, in the printing apparatus 100, sheets printed by the MFP body 200 can be discharged to the stacker 205, and can also be discharged to the finisher 209. A sheet conveyer path switch unit 213 provided in the stacker 205 can switch the output destination of a sheet conveyed by the stacker 205 to the stacker unit 206, the sample tray 212, or the downstream side of the stacker 205 (in other words, the finisher 209).

Figure 3A:
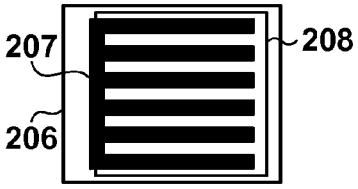
FIGS. 3A to 3I are diagrams for describing operations of a stacker unit.

FIGS. 3A to 3I are diagrams for describing operations of the stacker unit 206. FIG. 3A is a diagram of the lift tray 207 and the discharge tray 208 when viewed from above the stacker unit 206. FIGS. 3B to 3I are diagrams of the lift tray 207 and the discharge tray 208 when viewed from the left of the stacker unit 206.

Figure 3B:
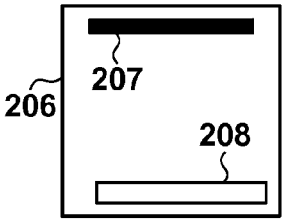

As shown in FIG. 3A, the lift tray 207 (a first stacking unit) and the discharge tray 208 (a second stacking unit) are configured so as to intersect with each other in a grid-like manner. Furthermore, the discharge tray 208 is configured to be able to slide to a position for a discharged item to be user retrievable. Sheets stacked to the lift tray 207 slide to the discharge tray 208 and are automatically restacked. As shown in FIG. 3B, when the stacking of sheets starts, the lift tray 207 is at the stack start position (the uppermost position) of the stacker unit 206, and the discharge tray 208 is inside the stacker unit 206.

Figure 3C:
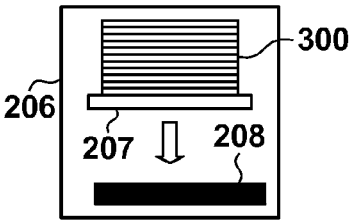
Figure 3D:
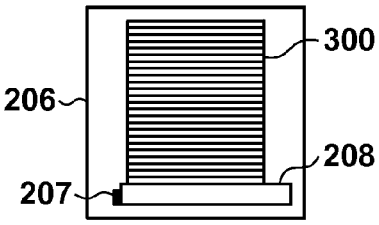

As shown in FIG. 3C, when the stacking of sheets 300 starts, the lift tray 207 gradually descends in accordance with the stacking amount. The distance and time of descent is different depending on the weight of the sheets. As shown in FIG. 3D, when the lift tray 207 is fully stacked and has descended to the lowermost portion, sheets 300 are automatically restacked onto the discharge tray 208. This is because the lift tray 207 and the discharge tray 208, as shown in FIG. 3A, are configured so as to intersect with each other in a grid-like manner.

Figure 3E:
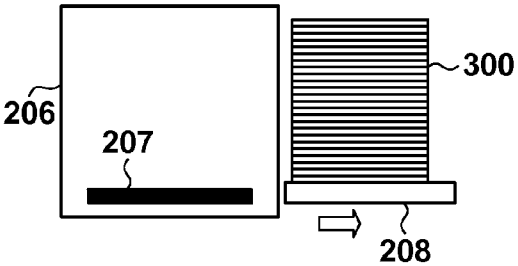
Figure 3F:
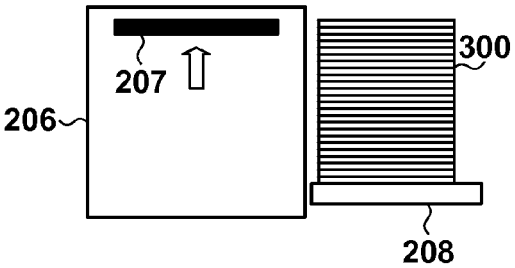
Figure 3G:
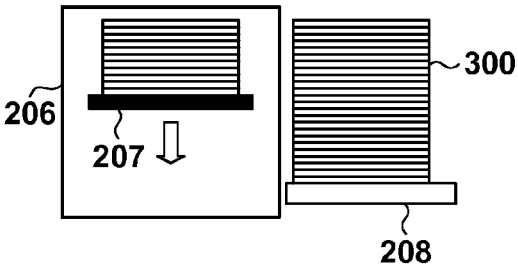

As shown in FIG. 3E, when the sheets 300 have been restacked onto the discharge tray 208, the discharge tray 208 has slid to the outside of the stacker unit 206. As shown in FIG. 3F, when the discharge tray 208 has slid to the outside of the stacker unit 206, the lift tray 207 has ascended to the stack start position. As shown in FIG. 3G, when the lift tray 207 has ascended to the stack start position, the stacking of sheets resumes.

Figure 3H:
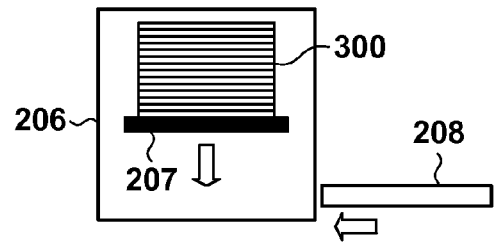
Figure 3I:
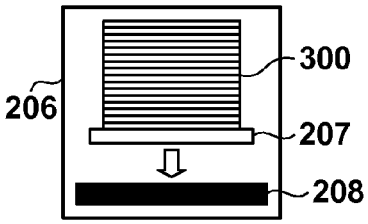

As shown in FIG. 3H, when the discharge tray 208 has slid to the outside of the stacker unit 206 and the sheet bundle on it has been retrieved by the user, the discharge tray 208 returns to the inside of the stacker unit 206. As shown in FIG. 3I, the stacking of sheets to the lift tray 207 can be continuously performed by the discharge tray 208 returning to a home position inside the stacker unit 206 while the lift tray 207 is stacking and descending.

Figure 4:
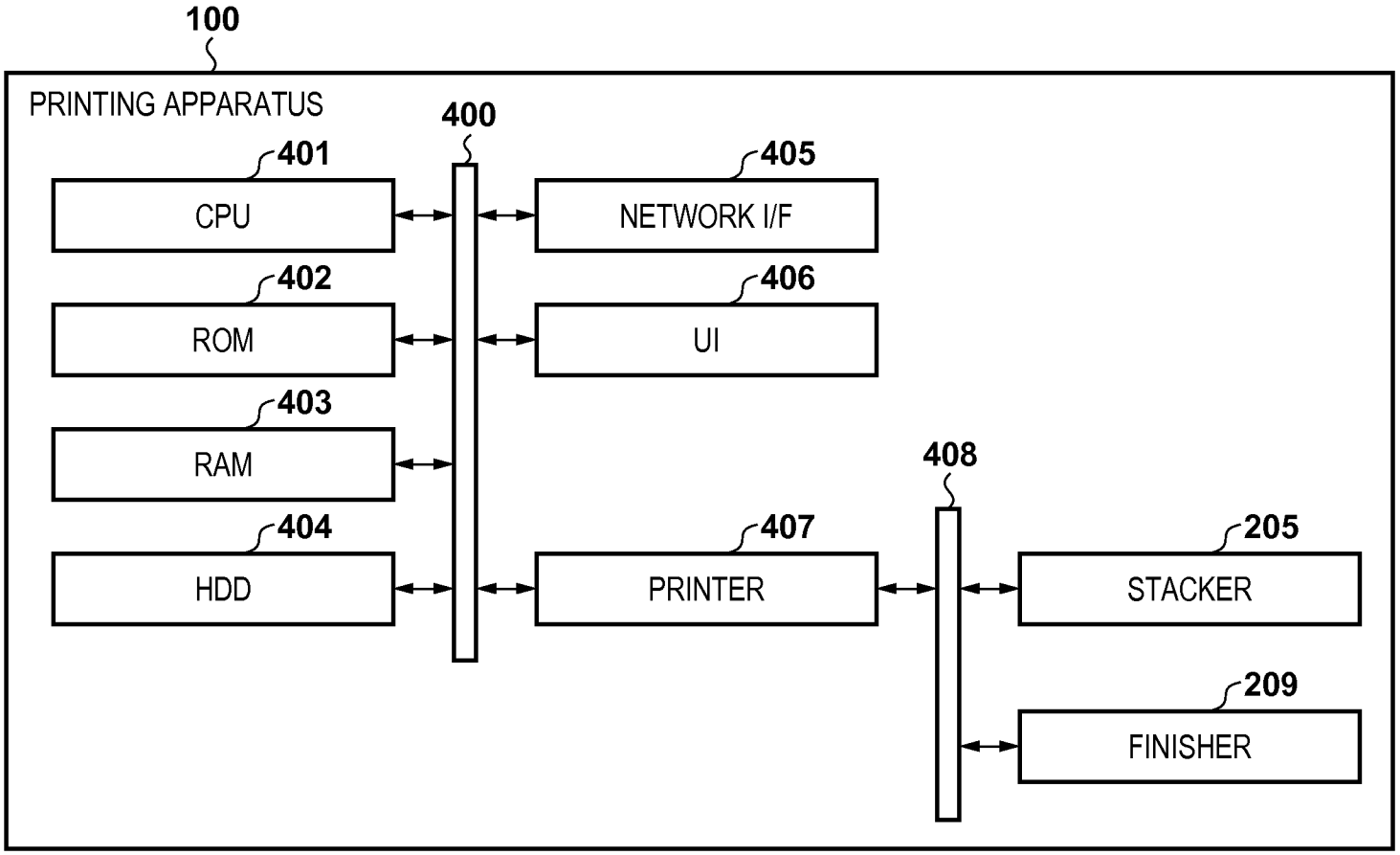
FIG. 4 is a block diagram showing a hardware configuration of the printing apparatus.

FIG. 4 is a block diagram showing the hardware configuration of the printing apparatus 100. The printing apparatus 100 includes a CPU 401, a ROM 402, a RAM 403, an HDD 404, a network interface (I/F) 405, and a user interface (UI) 406. These components are mutually connected via an internal bus 400.

The CPU 401 reads (loads) various types of programs stored in the ROM 402 or the HDD 404 to the RAM 403, and executes operations of the present embodiment, for example. The RAM 403 is used as a work memory that is necessary for the CPU 401 to operate, and temporarily stores data and variables, for example. The HDD 404 stores programs and various types of data before they are loaded to the RAM 403. The network I/F 405 is a communication interface for executing communication with the information processing apparatus 101 on the network 102. The UI 406 includes various types of buttons and a touch panel, etc. that are not shown in the diagrams, and receives instruction operations from the user, and displays a status of the printing apparatus 100, such as the operation mode.

A printer 407 is a printing unit that prints print target image data onto a sheet. The members from the CPU 401 to the printer 407 in FIG. 4 correspond to the MFP body 200 of FIG. 2. When the stacker 205 and the finisher 209 are successively connected to the downstream side of the MFP body 200, they are electrically connected to the printer 407 by a dedicated bus 408, and communication can be performed therebetween.

Figure 5:
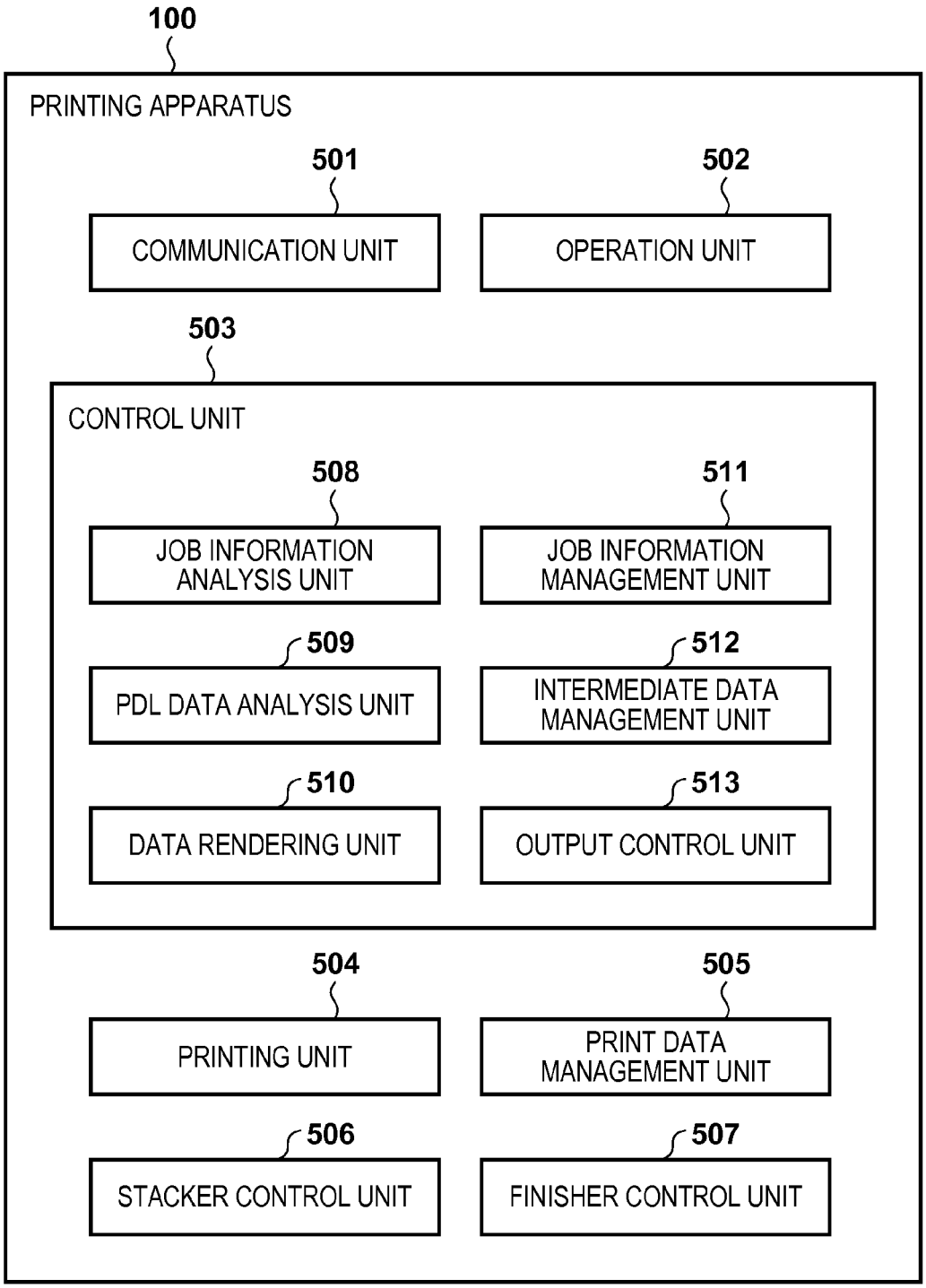
FIG. 5 is a block diagram showing a software configuration of the printing apparatus.

FIG. 5 is a block diagram showing the software configuration of the printing apparatus 100. The blocks shown in FIG. 5 are realized by the CPU 401 executing the programs stored in the ROM 402. A communication unit 501, an operation unit 502, a control unit 503, a printing unit 504, a print data management unit 505, a stacker control unit 506, and a finisher control unit 507 are realized by the CPU 401.

The communication unit 501 performs communication with other devices via the network I/F 405. The operation unit 502 receives various types of user instructions and operations from the UI 406 and displays the status of the printing apparatus 100 (the operation mode, the job execution status, etc.) on the UI 406. The control unit 503 performs various types of control based on job data that has been input to the printing apparatus 100. The printing unit 504 controls the printer 407 and performs printing. The print data management unit 505 stores image data that has been converted from job data into a bitmap by the control unit 503 to the HDD 404. The stacker control unit 506 performs control so that sheets printed by the printing unit 504 are discharged to the stacker 205. The finisher control unit 507 performs control so that sheets printed by the printing unit 504 are discharged to the finisher 209.

The control unit 503 has a job information analysis unit 508, a PDL data analysis unit 509, a data rendering unit 510, a job information management unit 511, an intermediate data management unit 512, and an output control unit 513. The job information analysis unit 508 performs analysis processing on job information from job data. The PDL data analysis unit 509 analyzes page data for each page from job data, and performs conversion processing into intermediate data such as a display list. Also, the PDL data analysis unit 509 accumulates and stores converted intermediate data to the intermediate data management unit 512 in the RAM 103.

The data rendering unit 510 performs processing for converting the intermediate data accumulated and stored in the intermediate data management unit 512 into bitmap data in units of pages, and accumulates and stores the resulting data to the print data management unit 505. The job information management unit 511 performs management of job information that has been analyzed by the job information analysis unit 508 and various types of statuses of printing jobs that are processed by the printing apparatus 100. The intermediate data management unit 512 stores the intermediate date that has been converted by the PDL data analysis unit 509. The output control unit 513 performs processing for converting the bitmap data in units of pages into a video signal, and performs image transfer processing in synchronization with image formation in the printing unit 504 and paper feed processing.

Figure 6:
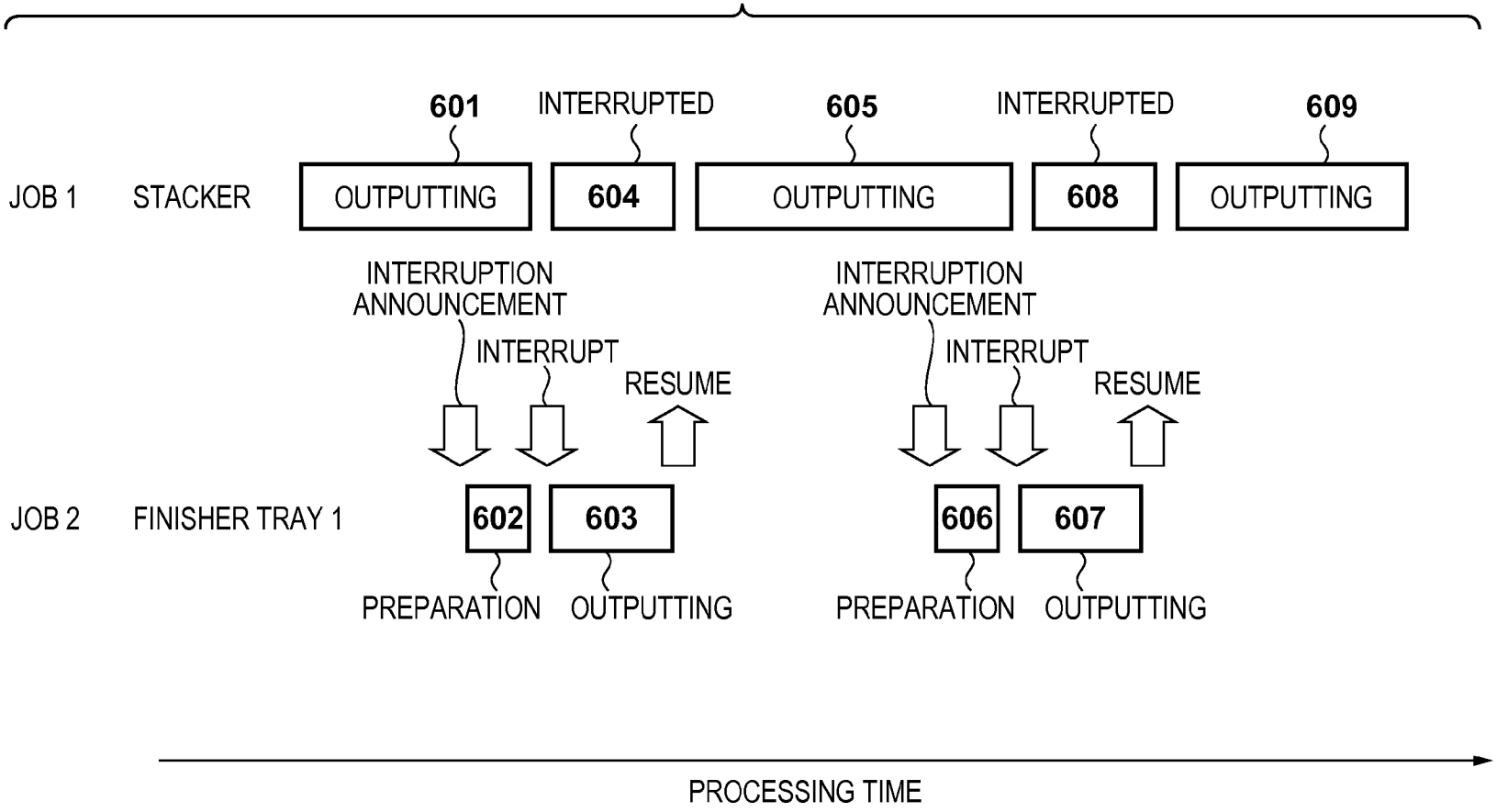
FIG. 6 is a diagram for describing job output processing.

FIG. 6 is a diagram for describing job output processing in the printing apparatus 100. FIG. 6 shows an example in which a preceding job 1 is output to the stacker unit 206, and a succeeding job 2 is output to the sheet discharge tray 211 of the finisher 209 while output to the stacker unit 206 is interrupted.

In step S601 in which the preceding job 1 is being output to the stacker unit 206, the control unit 503 monitors a pre-set timing for making an interruption announcement. The timing for the interruption announcement will be explained later, but it is determined based on the capability information of the stacker unit 206 with regards to the sheets to be output (the number of pages that can be stacked, etc.).

When the timing for the interruption announcement is reached, in step S602 the control unit 503 causes the finisher control unit 507 to perform finisher output preparation (discharge preparation). Then, when the output of the preceding job 1 to the stacker unit 206 is interrupted, in step S603 the control unit 503 outputs the succeeding job 2 to the sheet discharge tray 211 of the finisher 209.

Also, while the output to the stacker unit 206 is interrupted in step S604, if the number of sheets output to the sheet discharge tray 211 of the finisher 209 has reached a predetermined number of sheets, in step S605 the control unit 503 resumes output of the preceding job 1 to the stacker unit 206. This will be described later, but the number of sheets output to the sheet discharge tray 211 of the finisher 209 while output to the stacker unit 206 is interrupted, is determined based on the sheet conveying performance values of the MFP body 200, the stacker 205, and/or the finisher 209 with respect to output target sheets, and capability information of the stacker unit 206.

Thereafter, steps S606 to S609 are performed similarly to steps S602 to S605. As described above, in the present embodiment, due to performing the finisher output preparation when the stacker interruption announcement is made, finisher output can be started immediately when the stacker is interrupted, the total output time of the job 1 and the job 2 can be reduced, and processing efficiency can be improved.

Figure 7A:
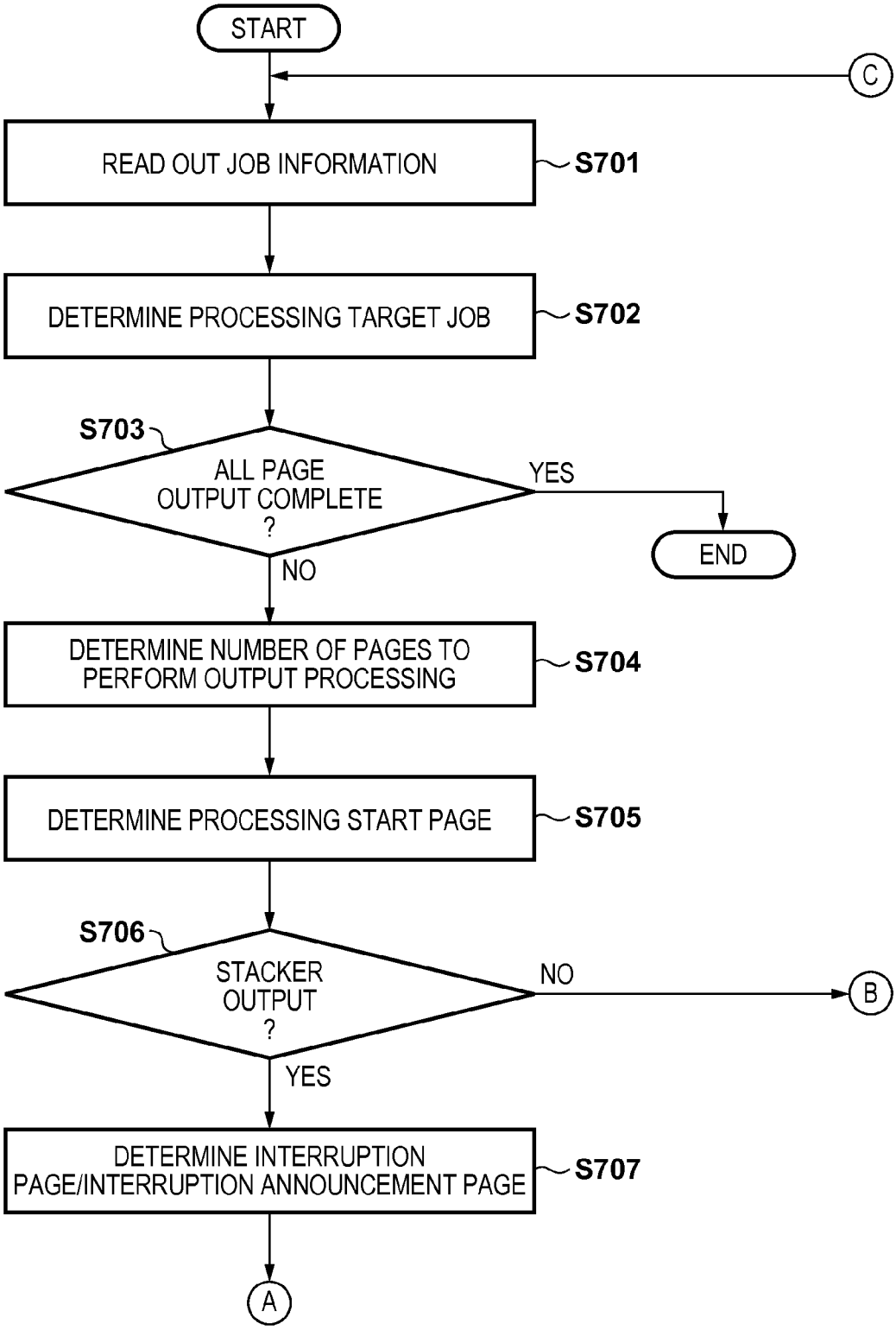
FIGS. 7A and 7B are flowcharts showing job output processing.
Figure 7B:
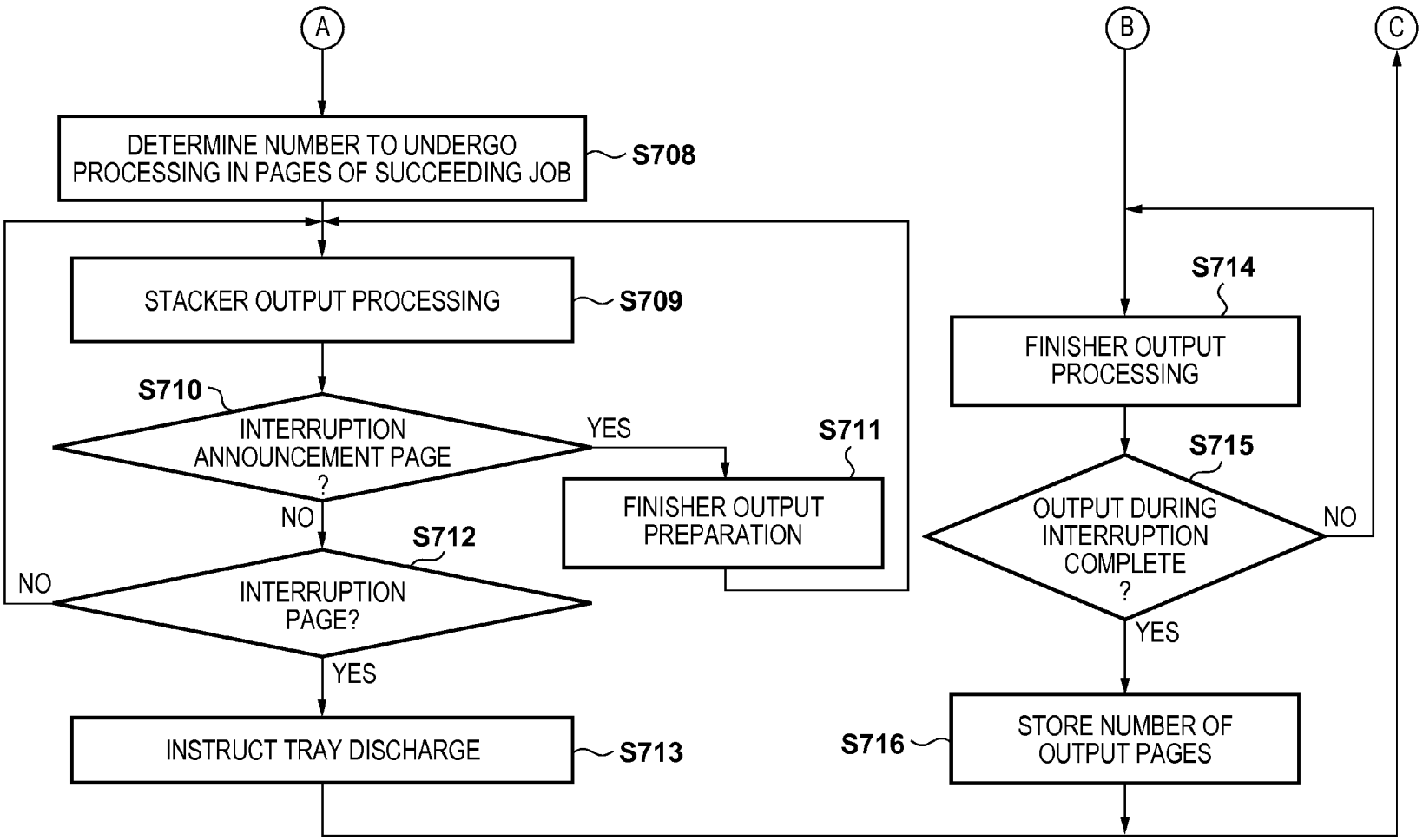

FIGS. 7A and 7B are flowcharts showing job output processing in the printing apparatus 100. The processes in FIGS. 7A and 7B are realized by the CPU 401 reading out a program stored in the ROM 402 to the RAM 403 and executing it, for example.

In step S701, the control unit 503 reads out the job information stored in the job information management unit 511. In the case of the execution order of a job 1 and then a job 2, the job that is to be output to the stacker unit 206 is read out as the job 1, and a job that is to be output to a unit other than the stacker unit 206 (e.g., the finisher 209) is output as the job 2.

In step S702, the control unit 503 determines the processing target job in FIGS. 7A and 7B based on the job information read out from the job information management unit 511. At this time, the control unit 503 determines the job 2 as the processing target job if it is the case that the processing of the job 1 was executed in step S713. Also, the job 1 is determined as the processing target job again if it is the case that the processing of the job 2 was executed in step S716.

In step S703, the control unit 503 determines whether or not the output of all of the pages that are to be processed is complete in the job that was determined in step S702 (hereinafter referred to as the "processing target job"). Here, in the case in which it was determined that the output of all of the pages is complete, the processing in FIGS. 7A and 7B ends. On the other hand, in the case in which it was determined that the output of all of the pages is not complete, the procedure moves to step S704.

In step S704, the control unit 503 determines the number of pages on which output processing is to be performed based on the job information of the processing target job. For example, all pages are to be processed in the case in which output processing has not been performed. In step S705, the control unit 503 determines the start page that is to undergo output processing based on the job information of the processing target job. For example, the first page is determined as the start page in the case in which output processing has not been performed.

In step S706, the control unit 503 determines whether or not the output destination of the processing target job is the stacker unit 206 based on the job information of the processing target job. Here, in the case in which it is determined that the output destination is the stacker unit 206, then the procedure moves to step S707, and in the case in which it is determined that the output destination is not the stacker unit 206, the procedure moves to step S714.

In step S707, the control unit 503 determines the page at which interruption of output of the processing target job is to be performed and the page at which the output interruption announcement is to be made, and stores the pages to the job information management unit 511. The page at which the output interruption is to be performed and the page at which the output interruption announcement is to be made are determined based on the following information, for example. The page at which the output interruption announcement is to be made may be determined by deducting a predetermined number of pages from the page at which output interruption is to be performed.

The remaining number of output sheets of the processing target job (number of original pages×number of units−number of sheets output)

Capability information of the stacker unit 206, which is managed by the stacker control unit 506 (number of stackable sheets for each sheet type (sheet weight))

The designated number of sets or the sheet discharge setting value for each designated number of sheets, which are input from the operation unit 502 (for example, output by the discharged tray 208 every 100 units)

For example, if the remaining number of output pages of the processing target job is 3000 sheets, and the number of sheets that can be stacked onto the stacker unit 206 is 1000 sheets, page 1000 and page 2000 are determined as the pages at which output interruption is to be performed. Also, for example, in the case in which the remaining number of output sheets of the processing target job is 1000 sheets, and the discharge of 100-page sets by the discharge tray 208 every three sets has been set, page 300, page 600 and page 900 are determined as the pages at which output interruption is to be performed.

In step S708, the control unit 503 determines the number of pages of the succeeding job that are to undergo output processing (number of discharge sheets) while output of the processing target job is interrupted, and stores this information to the job information management unit 511. The number of pages at which output of the succeeding job is to be performed is determined based on the following information, for example.

The amount of time that the discharge tray 208 in the stacker unit 206 takes to shift from the home position to the sheet bundle user retrieval position, which is managed by the stacker control unit 506

The amount of time that the lift tray 207 takes to shift from the lowermost position to the stack start position, which is managed by the stacker control unit 506

The sheet conveying performance value of the MFP body 200, which is managed by the output control unit 513

The sheet conveying performance value of the stacker 205, which is managed by the stacker control unit 506

The sheet conveying performance value of the finisher 209, which is managed by the finisher control unit 507

The paper conveying performance value of the MFP body 200 is, for example, the sheet conveyance time per sheet in the MFP body 200, which is the time required for a sheet to be fed to the stacker 205. Also, the sheet conveying performance value of the stacker 205 is, for example, the sheet conveyance time per sheet in the stacker 205, which is the time required for a sheet to be fed to the finisher 209. Also, the sheet conveying performance value of the finisher 209 is, for example, the sheet conveyance time required for a sheet to be discharged from the finisher 209 to the sheet discharge tray 210 or 211.

In step S709, the control unit 503 reads out image data that corresponds to one page from the print data management unit 505, and outputs the image data to the stacker unit 206 via the output control unit 513 and the stacker control unit 506.

In step S710, the control unit 503 determines whether or not the output target page is the output interruption announcement page calculated in step S707. Here, in the case in which it is determined that the page to be output is the output interruption announcement page, the procedure moves to step S711. In step S711, the control unit 503 instructs the finisher control unit 507 to perform output preparation in the finisher 209. Then, the finisher control unit 507 instructs the finisher 209 to perform wakeup, warm-up, and other output preparation. Following the processing in step S711, the procedure returns to step S709.

In the case in which it is determined that the page is not the output interruption announcement page in step S710, the procedure moves to step S712. The case in which it is determined that the page is not the output interruption announcement page in step S710, includes the case in which the output interruption announcement page has not yet been reached, and the case in which the output interruption announcement page has already been reached but the output interruption page has not been reached.

In step S712, the control unit 503 determines whether or not the output target page is the output interruption page. Here, the procedure moves to step S713 in the case in which it is determined that the output target page is the output interruption page, and the procedure returns to step S709 in the case in which it determined that the output target page is not the output interruption page.

In step S713, the control unit 503 instructs the stacker control unit 506 to perform discharge of a sheet bundle. Then, the stacker control unit 506 instructs the stacker 205 so that the discharge tray 207 performs a discharge operation. Following the processing in step S713, the number of completed output sheets of the processing target job is stored to the job information management unit 511. Thereafter, processing is repeated from step S701 with the succeeding job (job 2) as the new processing target job.

In the case in which it is determined that the output destination of the processing target job is not the stacker unit 206 in step S706, for example if the output destination was the finisher 209, the control unit 503 performs output to the finisher 209 via the finisher control unit 507 in step S714.

In step S715, the control unit 503 determines whether or not the number of output pages has reached the number of pages determined in step S708 (the number of pages to be output during interruption). Here, in the case in which it is determined that the number of pages output has not reached the number of pages to be output during interruption, the processing in step S714 is repeated. On the other hand, in the case in which it is determined that the number of output pages has reached the number of pages to be output during interruption, the control unit 503 stores the number of completed output pages of the processing target job to the job information management unit 511 in step S716. In step S715, if the remaining number of pages to be output to the finisher 209 is less than or equal to a predetermined threshold value, it may be deemed that the output of all pages to the finisher 209 is complete. Following the processing in step S716, the procedure returns to step S701.

FIG. 8 is a diagram showing an example of a job management table for managing job information. As shown in FIG. 8, a job ID 801, a status 802, input information 803, output information 804, and a data storage destination 805 of corresponding job data is managed in a job management table 800. Information indicating a link to the print data management unit 505 is described in the data storage destination 805. Also, a sheet output destination 806, a number of pages 807, and a number of sets 808 are managed in the input information 803. Information obtained from the job information analysis unit 508 and the PDL data analysis unit 509 is stored in the sheet output destination 806, the number of pages 807, and the number of sets 808. Also, a sheet output destination 809, a number of processed pages 810, a number of processed sets 811, and a number of processed output sheets 812, which are information obtained from the output control unit 513, are stored in the output information 804. Also, the interruption announcement page 813 determined in step S707 of FIG. 7A and the number of pages output during interruption 814 calculated in step S708 are stored in the job management table.

The job ID "1" is job data in which the number of pages 807 indicates 20 pages, the sheet output destination 809 indicates output to the "stacker", the processed number of units 811 indicates "150" sets, the processed number of output sheets 812 indicates "3000" sheets, and the status 802 indicates "interrupted". Also, the job ID "2" is job data in which the sheet output destination 809 indicates output to "Tray 1", the processed number of output sheets 812 indicates "90" sheets, and the status 802 indicates "printing".

Also, the job ID "4" and the job ID "5" are interrupted processing target jobs after output of the job ID "2" is complete. In the case in which output sheets of the job ID "2" remain in the tray 1 at the point at which processing starts, output is performed to "tray 2", and in the case in which no output sheets remain, output to "tray 1" is performed, but at the current point the sheet output destination 809 is "undetermined".

The control unit 503 determines the processing target job in step S702 with reference to the job management table in FIG. 8. FIG. 8 shows a state in which after the control unit 503 has performed processing of the job with the job ID=1 through to step S713, the process returns to step S701, and the state of the case in which processing of the job with the job ID=2 in step S714.

As described above, the preceding job 1 is output to the stacker 205, the stacker interruption announcement is made, finisher output preparation is performed, and the succeeding job 2 is output to the sheet discharge tray 211 of the finisher 209 while output to the stacker 205 is interrupted.

Figure 9:
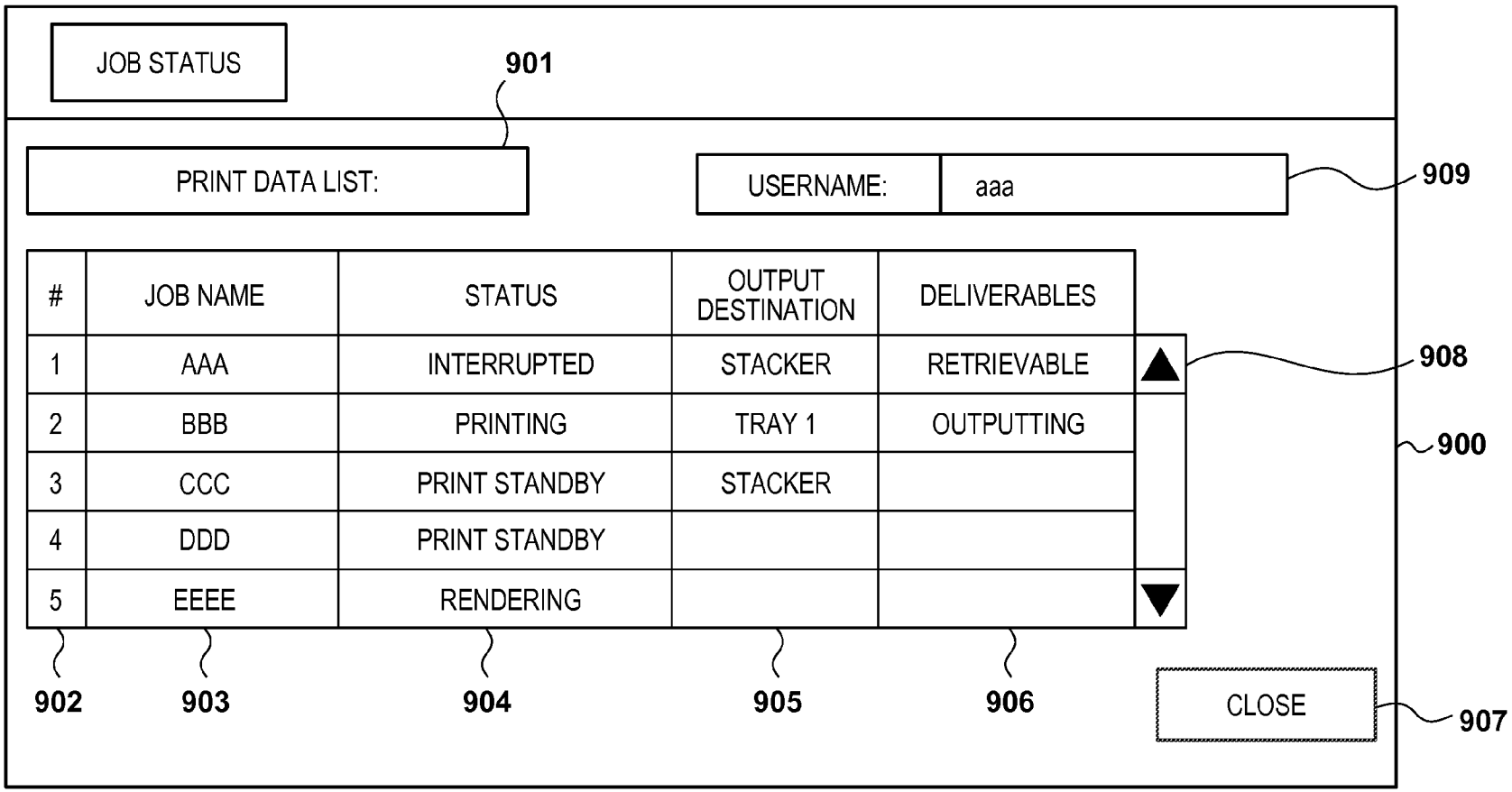
FIG. 9 is a diagram showing a job status display screen.

FIG. 9 is a diagram showing an example of a job status display screen displayed on the UI 406. As shown in FIG. 9, a job ID 902, a job name 903, a status 904, an output destination 905, and a status of deliverables at the output destination 906 in corresponding job data is displayed as a print data list 901 in the job status display screen 900. For example, concerning the job ID "1", the status 904 indicates "interrupted", but the state of deliverables at the output destination 906 indicates "retrievable". In other words, the user can retrieve a deliverable (a sheet bundle) of the job 1 from the stacker 205 and confirm that offline processing is executable.

According to the above description, in the case in which output to the finisher is to be performed during stacker processing interruption while sheets are being continuously output to the stacker, finisher output preparation is performed when a stacker interruption announcement is made, thus making it possible to immediately start the finisher output during stacker interruption. As a result, the total output time of the job 1 and the job 2 can be reduced, and processing efficiency can be improved.

Second Embodiment

In the present embodiment, degrees of priority (priority rankings) are set for multiple jobs that succeed a stacker output job, and the processing target job that can be processed while processing of the stacker output job is interrupted is determined based on the set degrees of priority.

Figure 10:
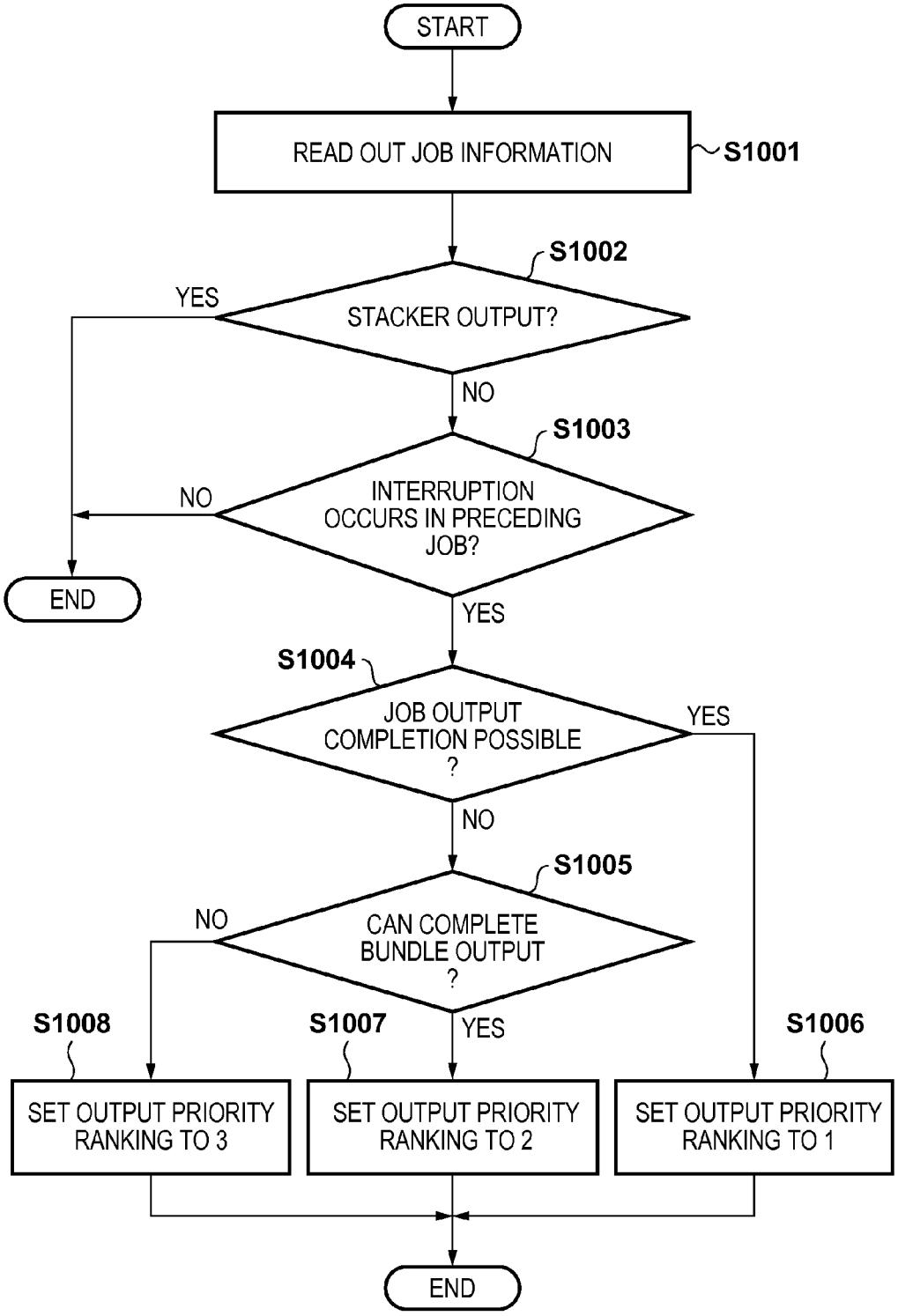
FIG. 10 is a flowchart showing processing for determining a job priority ranking (a job priority order).

FIG. 10 is a flowchart showing processing for determining a job priority ranking in the present embodiment. The processes in FIG. 10 are realized by the CPU 401 reading out a program stored in the ROM 402 to the RAM 403 and executing it.

In step S1001, when the intermediate data of each job has been stored and accumulated in the intermediate data management unit 512, the control unit 503 reads out a piece of job information from the job information management unit 511. In step S1002, the control unit 503 determines whether or not the output destination of the corresponding job is the stacker 205 based on the read out job information (the output destination 806). Here, the processing in FIG. 10 ends in the case in which it is determined that the output destination is the stacker 205. On the other hand, the procedure moves to step S1003 in the case in which it is determined that the output destination is not the stacker 205.

In step S1003, in the case in which the job preceding the corresponding job is a stacker output job (a job output to the stacker unit 206) the control unit 503 determines whether or not interruption due to discharge processing will occur during stacker output processing of the preceding job. This determination is performed based on, for example, capability information of the stacker unit 206 (the stackable number of sheets for every sheet type (sheet weight)), sheet information of the preceding job, and the number of output sheets calculated from the number of pages/number of sets. For example, it is determined that an interruption will occur in the case in which the number of output sheets is greater than the stackable number of sheets.

Here, in the case in which it is determined that an interruption due to a discharge operation will occur during stacker output processing, the procedure moves to step S1004. In step S1004, the control unit 503 determines whether or not the output of the entire corresponding job in finisher output can be completed while the stacker output processing is interrupted, based on the information described in step S708, job sheet information, and the number of output sheets calculated from the number of pages and number of sets. Here, in step S1006, in the case in which it was determined that the output of the entire corresponding job can completed, the control unit 503 determines that the degree of output priority of the corresponding job is [1], and stores this in the job information management unit 511. On the other hand, the procedure moves to step S1005 in the case in which it was determined that the output of the entire corresponding job cannot be completed.

In step S1005, the control unit 503 determines whether or not output of a predetermined unit of finishing of the corresponding job can be completed. The predetermined unit of finishing is, for example, a unit of a bundle that is bundled by a staple. Here, in the case in which it was determined that output of a unit bundle of the corresponding job can be completed, in step S1007 the control unit 503 determines that the output degree of priority of the corresponding job is [2] and stores this in the job information management unit 511. On the other hand, in the case in which it was determined that output of a unit of a bundle of the corresponding job cannot be completed, in step S1008 the control unit 503 determines that the output degree of priority of the corresponding job is [3] and stores this in the job information management unit 511.

In step S1004 and S1005, whether or not the entire job or output of a unit of finishing can be completed may be further determined based on the remaining quantity of sheets in the sheet feeding cassettes, and execution information regarding regularly implemented calibration, or the like that are managed by the output control unit 513.

FIG. 11 is a diagram showing an example of a job management table that manages the job priority rankings. As shown in FIG. 11, a degree of output priority 1101 is managed in addition to the information in FIG. 8, in the job management table 800.

Figure 12:
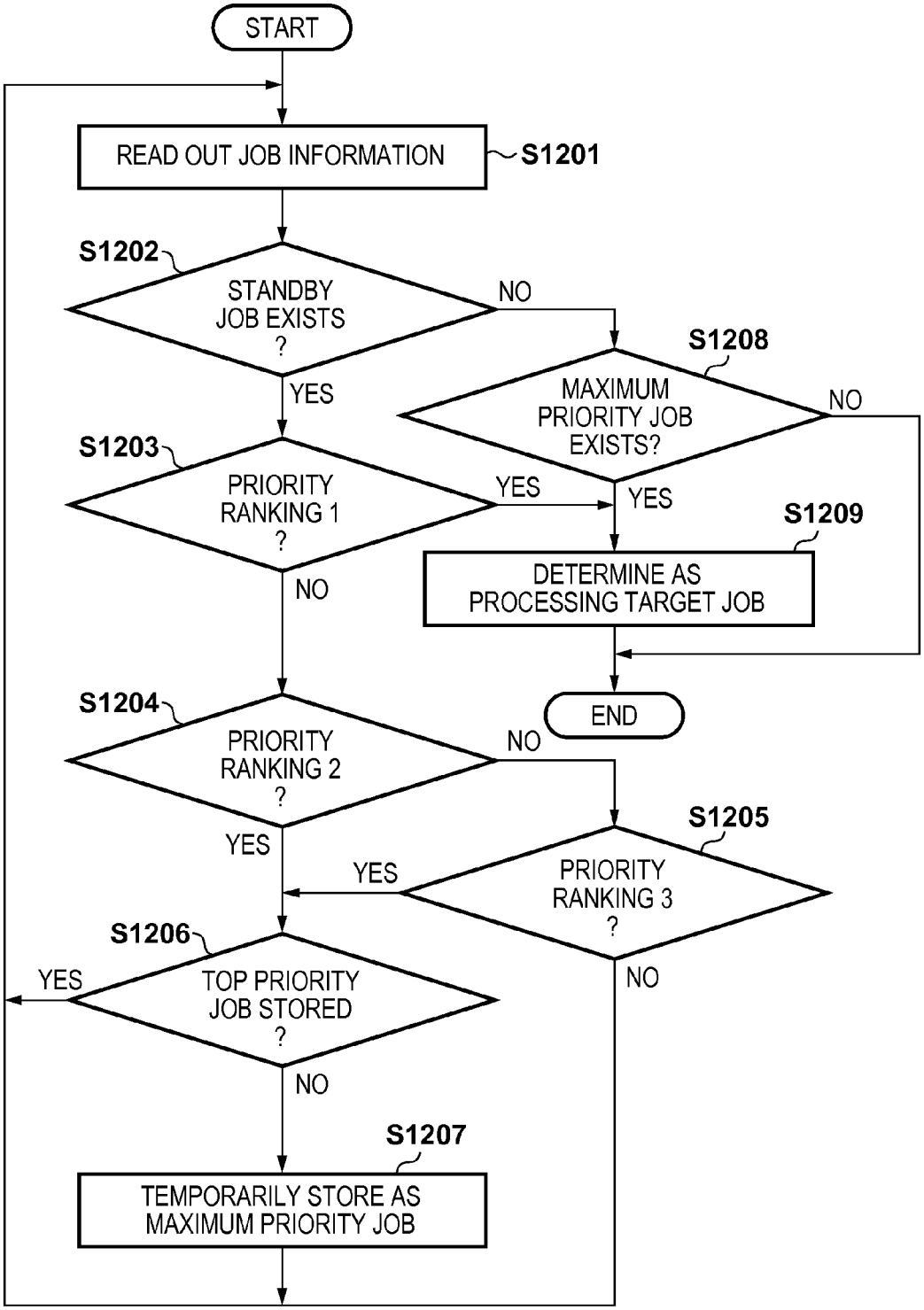
FIG. 12 is a flowchart showing processing for determining a processing target job.

FIG. 12 is a flowchart showing processing for determining a processing target job that is based on the job priority ranking. The processes in FIG. 12 are realized by the CPU 401 reading out a program stored in the ROM 402 to the RAM 403 and executing it.

In step S1201, when discharge output from the stacker control unit 506 to the stacker unit 206 starts, the control unit 503 reads out a piece of job information from the job information management unit 511. In step S1202, the control unit 503 determines from the read-out job information (output destination 806) whether or not a determination has been made for all of the jobs that are in output-standby and do not have the stacker unit 206 as the output destination. Here, the procedure moves to step S1203 in the case in which the determination is complete, and the procedure moves to step S1208 in the case in which the determination is not complete.

In step S1203, the control unit 503 determines whether or not the degree of output priority of the current job in focus is [1]. Here, in the case in which it is determined that the degree of output priority is [1], the procedure moves to step S1209 and the corresponding job is determined to be the processing target job. On the other hand, the procedure moves to step S1204 in the case in which it is determined that the degree of output priority is not [1].

In step S1204, the control unit 503 determines whether or not the degree of output priority for the corresponding job is [2]. Here, in the case in which it is determined that the degree of output priority is [2], the procedure moves to step S1206 and the control unit 503 determines whether or not a job that has a degree of output priority [2] or more has been stored to a top priority job temporary storage region. The top priority job temporary storage region is ensured in the RAM 403, for example. In the case in which it is determined that a job with a degree of output priority [2] or more is stored in the top priority job temporary storage region in step S1206, processing from step S1201 repeated. However, in the case in which it is determined that a job with a degree of output priority [2] or more is not stored in the top priority job temporary storage region in step S1206, the procedure moves to step S1207. In step S1207, the control unit 503 stores the information of the corresponding job as a top priority job in the top priority job temporary storage region, and thereafter processing from step S1201 is repeated. At this time, in the case in which it is determined that a top priority job is already stored, the job is updated to a top priority job.

In the case in which it is determined that the degree of output priority is not [2] in step S1204, the procedure moves to step S1205, and the control unit 503 determines whether or not the degree of output priority of the corresponding job is [3]. Here, in the case in which it is determined that the degree of output priority is [3], the procedure moves to step S1206 and the control unit 503 determines whether or not a job that has a degree of output priority [3] or more has been stored to the top priority job temporary storage region. Processing from step S1201 is repeated in the case in which it is determined that a job that has a degree of output priority [3] or more is stored in the top priority job temporary storage region in step S1206. On the other hand, the procedure moves to step S1207 in the case in which it is determined that a job that has a degree of output priority [3] or more has not been stored to the top priority job temporary storage region. In step S1207, the control unit 503 stores the information of the corresponding job as a top priority job in the top priority job temporary storage region, and thereafter processing is repeated from step S1201. At this time, in the case in which it is determined that a top priority job is already stored, the job is updated to a top priority job.

Processing is repeated from step S1201 in the case in which it is determined that the degree of output priority is not [3] in step S1205.

If it was determined in step S1202 that a determination has been made for all jobs on output standby, excluding jobs with an output destination that is the stacker unit 206, in step S1208 the control unit 503 determines whether or not there are jobs stored in the top priority job temporary storage region. Here, in the case in which it is determined that a job has been stored to the top priority job temporary storage region, in step S1209 the control unit 503 determines the corresponding job to be the processing target job to be processed while the output of the stacker output job is interrupted. On the other hand, the processing in FIG. 12 ends in the case in which it is determined in step S1208 that a job is not stored in the top priority job temporary storage region.

As described above, in the present embodiment, a degree of priority is set for each job that succeeds a stacker output job, and the processing target job is determined based on the degrees of priority.

Third Embodiment

In the present embodiment, the total output time of a stacker output job can be reduced by, while the processing of the stacker output job is interrupted by the stacker output, outputting the succeeding pages of the stacker output job to another sheet discharging apparatus, other than the stacker unit 206.

Figure 13A:
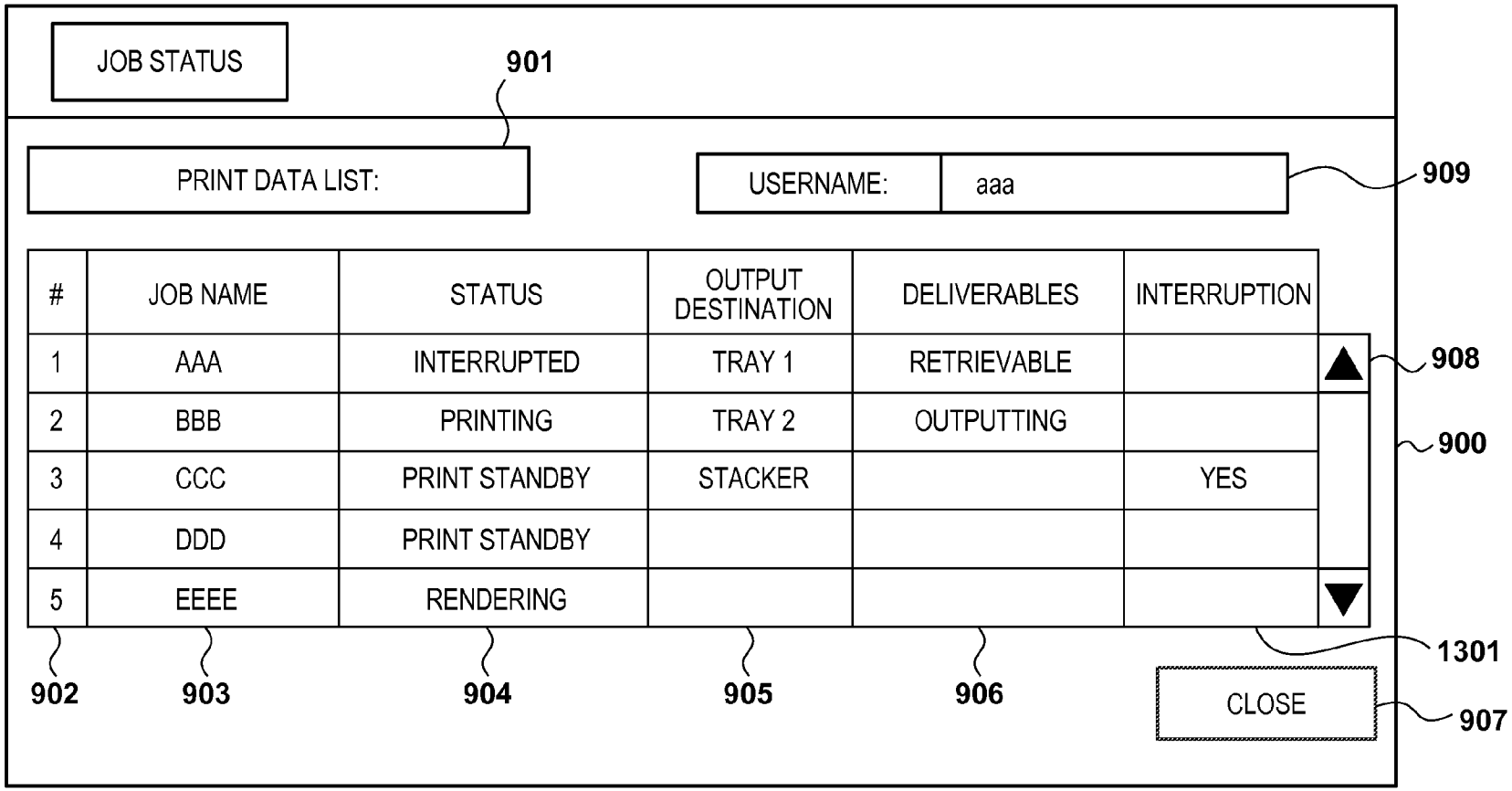
FIGS. 13A to 13C are other diagrams showing a job status display screen.
Figure 13B:
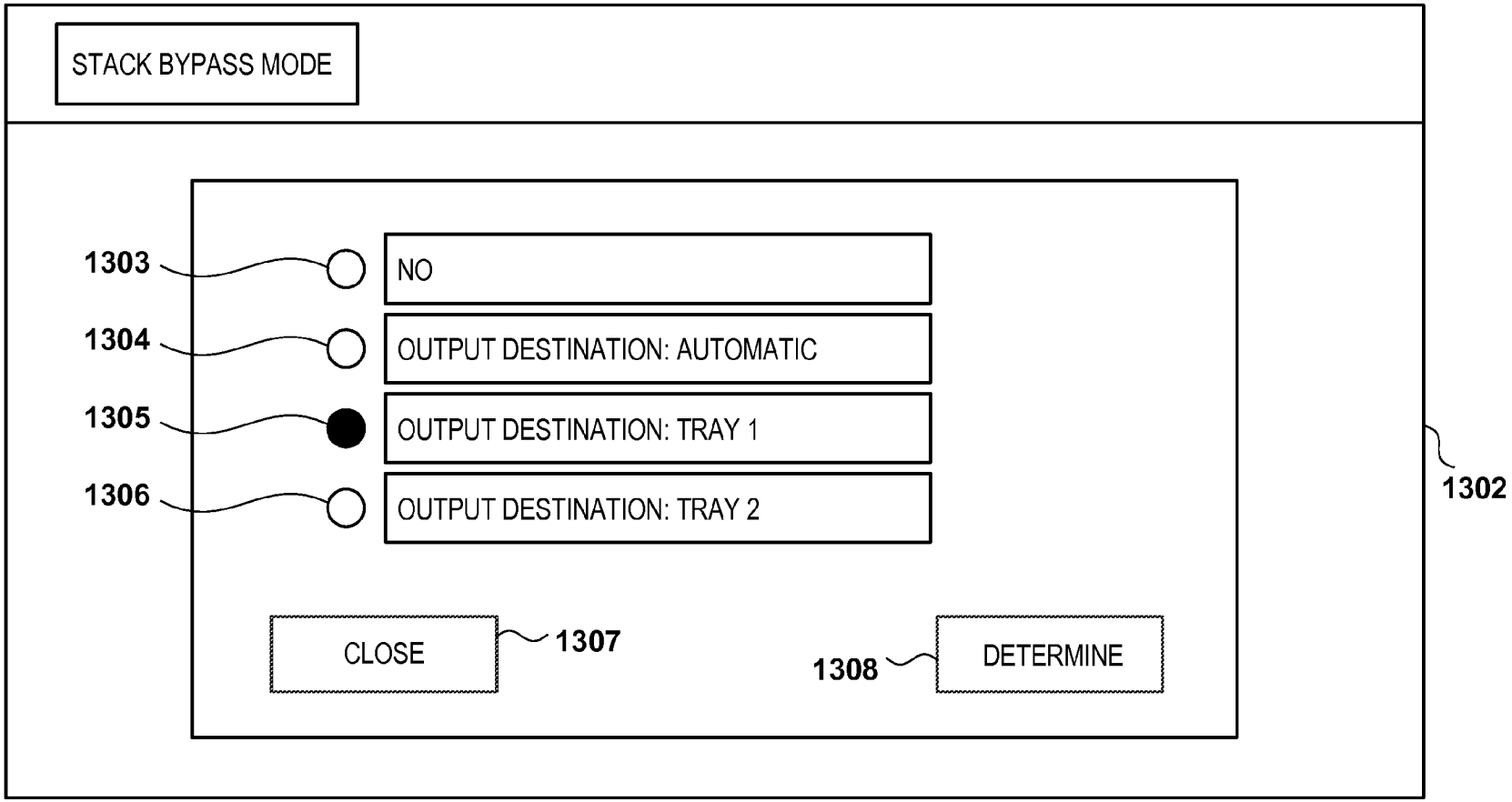
Figure 13C:
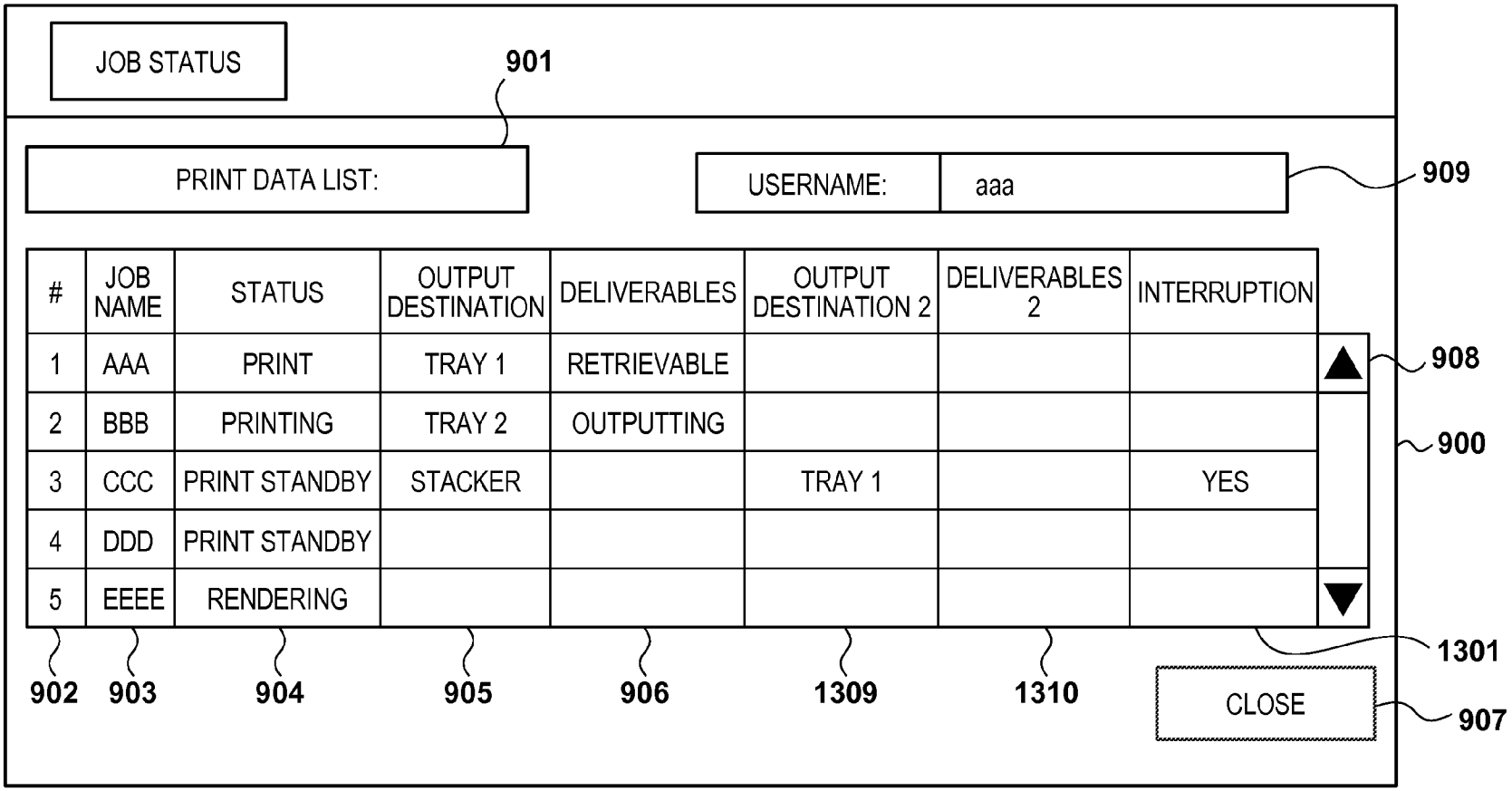

FIGS. 13A to 13C are diagrams showing an example of the job status display screen that displays the status of a job. Interruption information 1301 that shows whether or not processing interruption due to stacker output will occur when the stacker output job is executed, is displayed on the job status display screen 900 in FIG. 13A. Here, as shown in FIG. 13B, a processing mode selection screen 1302 for the corresponding job is displayed by the user selecting the interruption information 1301.

In the case in which the user selects a [No] button 1303 on the processing mode selection screen 1302, the corresponding job is output to the stacker unit 206 only, and output to another sheet discharging apparatus is not performed. Also, in the case in which the user selects an "output destination: automatic" button 1304, the corresponding job is output to the stacker unit 206, and the succeeding pages are output to another sheet discharging apparatus, other than the stacker unit 206.

Also, in the case in which the user selects an "output destination: tray 1" button 1305, the corresponding job is output to the stacker unit 206, and succeeding specified pages are output to the tray 211 due to selection by the user. Also, in the case in which the user selects an "output destination: tray 2" button 1306, the corresponding job is output to the stacker unit 206, and succeeding specified pages are output to the tray 210 due to selection by the user.

When a button other than the [No] button 1303 is selected on the processing mode selection screen 1302 and a determining button 1306 is pressed, the job status display screen 900 is displayed as shown in FIG. 13C. Specifically, a display 1309 that shows a second output destination (output destination 2) of the corresponding job and a display 1310 that shows the status of deliverables at the output destination 2 are displayed on the job status display screen 900.

Figure 14A:
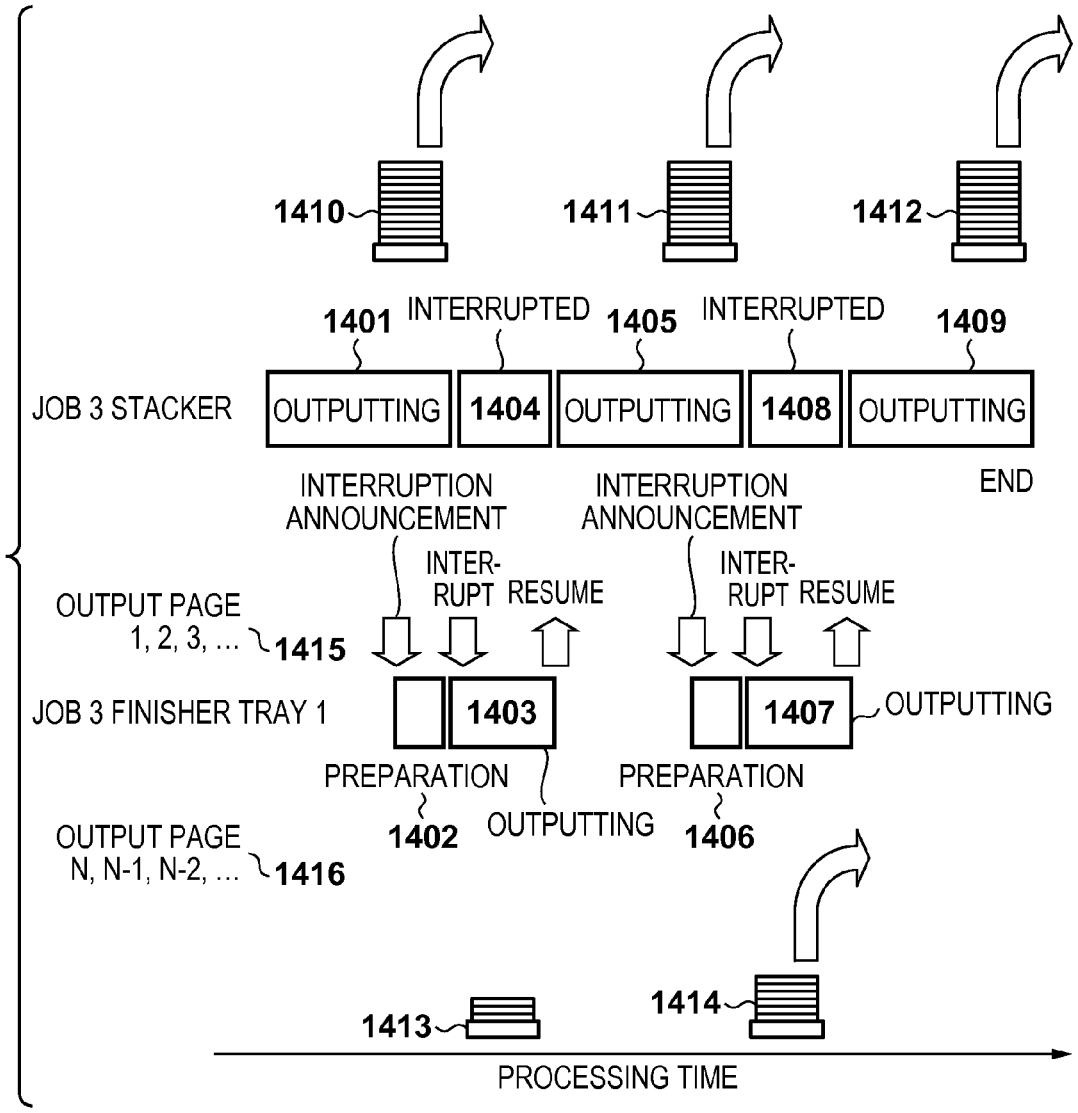
FIGS. 14A and 14B are other diagrams for describing job output processing.
Figure 14B:
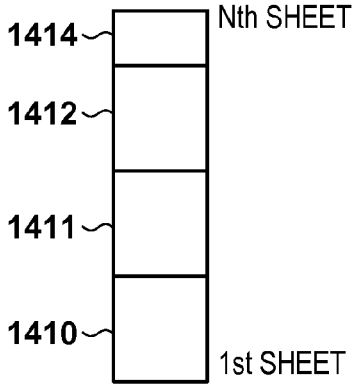

FIGS. 14A and 14B are diagrams for describing job output processing in the present embodiment. Below is a description of an example in which the stacker output job (job 3) is output from the first page to the stacker unit 206, and while output to the stacker unit 206 is interrupted, the job 3 is in reverse order output from the final page to the sheet discharge tray 211 of the finisher 209.

In step S1401 shown in FIG. 14A, the control unit 503 monitors a pre-set timing for making an interruption announcement while the job 3 is being output from the front page to the stacker unit 206. Here, a description of the timing for making an interruption announcement is the same as the description in the first embodiment.

When the timing for making an interruption announcement is reached, in step S1402 the control unit 503 instructs the finisher control unit 507 to perform a finisher output preparation 1406. Then when output of the job 3 to the stacker unit 206 is interrupted, in step S1403 the control unit 503 outputs the job 3 in reverse order from the final page to the sheet discharge tray 211 of the finisher 209. Also, the status of deliverables at the output destination 906 is displayed as "retrievable" on the job status display screen 900, and the user is prompted to retrieve a sheet bundle 1410 from the stacker unit 206.

While output to the stacker unit is interrupted in step S1404, when the number of sheets discharged to the sheet discharge tray 211 of the finisher 209 has reached a predetermined number of pages, the control unit 503 resumes output of the job 3 to the stacker unit 206 in step S1405.

Thereafter, in the case in which interruption of output to the stacker unit 206 reoccurs, steps S1406 to S1409 are performed similarly to steps S1402 to S1405. At that time, the status of deliverables 1310 at the output destination 2 is displayed as "outputting" on the job status display screen 900, and the user is prevented from performing retrieval of a sheet bundle 1413 on the sheet discharge tray 211. If an interruption in output to the stacker unit 206 ceases, the status of deliverables 1310 at the output destination 2 is displayed as "retrievable" on the job status display screen 900, and the user is prompted to retrieve a sheet bundle 1414 on the sheet discharge tray 211.

As a result of the above processing, by combining the sheet bundle 1414 on the sheet discharge tray 211 and the sheet bundles 1410 to 1412 output to the stacker unit 206 as shown in FIG. 14B, the user can obtain the output deliverables of the job 3. Also, regarding the stacker output job, the total output time of the stacker output job can be reduced by outputting specified succeeding pages to another sheet discharging apparatus, other than the stacker, while the stacker output processing is interrupted.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). he computer may comprise one or more processors (e.g., central processing unit (CPU), micro processing unit (MPU)) and may include a network of separate computers or separate processors to read out and execute the computer executable instructions. he computer executable instructions may be provided to the computer, for example, from a network or the storage medium. he storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-167956, filed Aug. 20, 2014, which is hereby incorporated by reference herein in its entirety.

What is claimed is:

1. A printing apparatus that can discharge sheets to a stacking apparatus that includes a first stacking unit onto which discharged sheets are stacked, and a second stacking unit onto which the sheets stacked onto the first stacking unit can be caused to slide from the first stacking unit to a position for user retrieval, the printing apparatus comprising:

a first control unit configured to control execution of a first job of discharging sheets to the stacking apparatus, and a second job of discharging sheets to a finisher that is different from the stacking apparatus; and a second control unit configured to perform sheet discharge preparation in the finisher before the discharge of sheets to the stacking apparatus is interrupted by an operation for sliding the stacked sheets to the position for the user retrieval, wherein the first control unit executes the second job when sheet discharge preparation is performed in the finisher by the second control unit.

2. The printing apparatus according to claim 1, wherein the second control unit, based on a number of sheets to be discharged by execution of the first job, performs the sheet discharge preparation in the finisher before the discharge of sheets to the stacking apparatus is interrupted by the operation for sliding the stacked sheets to the position for the user retrieval.

3. The printing apparatus according to claim 2, wherein the first control unit interrupts execution of the second job and resumes execution of the first job when a number of sheets discharged to the finisher by execution of the second job reaches a first predetermined number of sheets.

4. The printing apparatus according to claim 3, wherein the first predetermined number of sheets is a number of sheets that can be discharged to the finisher while discharge to the stacking apparatus is interrupted.

5. The printing apparatus according to claim 1, wherein the second control unit performs sheet discharge preparation in the finisher when the number of sheets discharged to the stacking apparatus reaches a number of sheets that is based on a number of sheets that can be stacked in the stacking apparatus.

6. The printing apparatus according to claim 1, wherein the second job is a job that is different from the first job, and the second job is a job that is determined based on a priority order from among a plurality of jobs that are to be executed after the first job.

7. The printing apparatus according to claim 6, wherein the priority order is determined based on whether or not a job is a job in which all of the sheets can be discharged while the discharge of sheets to the stacking apparatus is interrupted.

8. The printing apparatus according to claim 7, wherein the priority order is determined also based on whether or not a job is job in which discharge of sheets in a predetermined unit of finishing can end while the discharge of sheets to the stacking apparatus is interrupted.

9. The printing apparatus according to claim 1, wherein the first job and the second job are the same job, and in a case in which the discharge of sheets to the stacking apparatus is interrupted by the operation, the first control unit executes a corresponding job so that sheets are discharged to the finisher in reverse order from a final page of the corresponding job.

10. A control method executed in a printing apparatus that can discharge sheets to a stacking apparatus that includes a first stacking unit onto which discharged sheets are stacked, and a second stacking unit onto which the sheets stacked onto the first stacking unit can be caused to slide from the first stacking unit to a position for user retrieval, the control method comprising:

a first control step of controlling execution of a first job in which sheets are discharged to the stacking apparatus and a second job in which sheets are discharged to a finisher different from the stacking apparatus; and a second control step of performing discharge preparation in the finisher before the discharge of sheets to the stacking apparatus is interrupted by an operation for sliding the stacked sheets to the position for user retrieval, wherein in the first control step, the second job is executed when sheet discharge preparation is performed in the finisher in the second control step.

* * * * *